US009247813B2

(12) United States Patent
Traut

(10) Patent No.: US 9,247,813 B2
(45) Date of Patent: Feb. 2, 2016

(54) SEATING FURNITURE WITH INTEGRATED TABLE FUNCTION

(75) Inventor: Andreas Traut, Köln (DE)

(73) Assignee: Gusto Products & Services GmbH, Kolg (DE)

( * ) Notice: Subject to any disclaimer, the term of this patent is extended or adjusted under 35 U.S.C. 154(b) by 44 days.

(21) Appl. No.: 14/241,317

(22) PCT Filed: Feb. 29, 2012

(86) PCT No.: PCT/EP2012/053389

§ 371 (c)(1),
(2), (4) Date: Sep. 12, 2014

(87) PCT Pub. No.: WO2013/029807

PCT Pub. Date: Mar. 7, 2013

(65) Prior Publication Data

US 2015/0015033 A1 Jan. 15, 2015

(30) Foreign Application Priority Data

Sep. 1, 2011 (DE) ..... 20 2011 051 177 U

(51) Int. Cl.

| | |
|---|---|
| ***A47B 85/04*** | (2006.01) |
| ***A47B 83/02*** | (2006.01) |
| ***A47C 13/00*** | (2006.01) |
| ***A47C 3/00*** | (2006.01) |

(52) U.S. Cl.

CPC ..... *A47B 85/04* (2013.01); *A47B 83/02* (2013.01); *A47C 3/00* (2013.01); *A47C 13/00* (2013.01)

(58) Field of Classification Search

CPC ..... A47C 13/00; A47C 7/024; A47C 9/08; A47C 3/18; A47C 3/00; A47C 9/02; A47B 83/02

USPC ..... 297/124, 126–127, 172–173, 92, 119, 297/129, 233–236, 283.3

See application file for complete search history.

(56) References Cited

U.S. PATENT DOCUMENTS

| | | | | |
|---|---|---|---|---|
| 468,052 | A * | 2/1892 | Cannon | 297/127 |
| 1,010,086 | A * | 11/1911 | Steele | 297/35 |
| 1,757,960 | A * | 5/1930 | Greenstreet | 297/124 |
| 2,593,271 | A * | 4/1952 | Cockrell | 297/127 |
| 2,645,273 | A * | 7/1953 | Culbertson et al. | 297/126 |
| 2,820,507 | A * | 1/1958 | Provencher | 297/126 |
| 3,361,470 | A * | 1/1968 | Erickson et al. | 297/124 |
| 4,194,784 | A * | 3/1980 | Dostal et al. | 297/126 |
| 5,292,172 | A * | 3/1994 | Watts et al. | 297/127 |
| 6,659,543 | B2 * | 12/2003 | McCutcheon et al. | 297/127 |
| 6,773,059 | B2 * | 8/2004 | Volotsenko | 297/129 |
| 7,429,077 | B2 * | 9/2008 | Yul | 297/124 |
| 7,578,551 | B2 * | 8/2009 | Linero | 297/107 |

(Continued)

*Primary Examiner* — Beth Stephan

(74) *Attorney, Agent, or Firm* — Jennifer S. Stachniak

(57) ABSTRACT

An item of seating furniture in the form of a bench (10) includes a backrest (11) and a seating surface (12), and has two rear support legs (13) arranged in the backrest (11) plane and two front support legs (14) arranged in each of the front outer corner regions of the seating surface (12). The seating surface (12) is divided perpendicularly to the plane of the backrest (11) and each of the seating surface parts (25) formed in this manner also have at least one inner-lying support leg (16). The two seating surface parts (25) can be pivoted outwards about their respective rear support legs (13) and into a seating position. The backrest (11), which is pivotally mounted on a main frame, can be pivoted into a horizontal table position.

6 Claims, 3 Drawing Sheets

(56) References Cited

U.S. PATENT DOCUMENTS 8,550,547 B1 * 10/2013 Liu ..... A47B 85/04
297/121

2013/0328358 A1 * 12/2013 Traut ..... A47C 7/70
297/173

* cited by examiner

SEATING FURNITURE WITH INTEGRATED TABLE FUNCTION

The instant application should be granted the priority dates of Sep. 1, 2011, the filing date of the corresponding German patent application DE 20 2011 051 177.4, as well as Feb. 29, 2012, the filing date of the International patent application PCT/EP2012/053389.

BACKGROUND OF THE INVENTION

The invention relates to an item of seating furniture in the form of a bench with a backrest and a seating surface with two rear support leg arranged in the plane of the backrest and two front support legs disposed respective in the front outer corner regions of the seating surface.

As far as this type of seating furniture is generally known to be used, a bench available as seating furniture merely permits the function of a seat, in particular of two or more people sitting next to one another on the seating surface. Often, situations arise in which a shelf in the form of a table top is desired. Providing a special table, however, is often not possible due to space considerations; further, providing a special table also means an additional expenditure of space for its storage as well as an additional manufacturing expense for table to be specially made.

SUMMARY OF THE INVENTION

The invention is based on the object of providing seating furniture of the above-noted type, which, in addition to being suitable for a pure seating function, offers at least one other function.

The solution of this object is provided by advantageous embodiments and further developments of the invention as set forth in the content of the patent claims, which follow this description.

The invention relates in its basic concept to an item of seating furniture in the form of a bench having a backrest and a seating surface, in which the seating surface is divided perpendicularly to the plane of the backrest and each seating surface part formed thereby has at least one inner support leg in addition to its front support leg, and whereby the two seating surface parts can be pivoted about their respective rear support legs into a seating position that is lateral to the backrest, and the backrest pivotably mounted at a base position can be pivoted from its backrest position between the seating surface parts that are outwardly pivotable into a horizontal table position that has a vertical spacing to the seating surface of the seating surface part and can be fixed into this table position by means of a support mounted to the main frame.

The present invention offers the advantage that the seating furniture according to the present invention first allows functional seating for preferably two people sitting on the seating surface. If then, for example, a shelf surface were to be produced, then both portions of the seating surface, according to the present invention, are pivoted outwardly at 90° so that an intermediate space that corresponds to the width of the bench or the backrest is free. In this intermediate space, the backrest is folded up from its backrest position about its bracket to a main frame and fixed into a table position by means of a support held on the main frame, so that in this manner, in contrast to a typical bench, a seating group comprised of two opposite seats with a table lying therebetween is produced. In this connection, the present invention offers the advantage that if needed, a table top can be folded out from the bench construction and can be used in this function, without requiring an additional table. In the frame of application according to the present invention, merely the width of the original seating bench is enlarged, without, however, requiring additional space for a table provided in front of the bench. In addition, the table surface remains within the space encompassed by the bench.

According to an exemplary embodiment of the invention, it is provided that the backrest is pivotable about a cross bar extending parallel to the seating surface and arranged at an upper end of the main frame.

For installation of the supports required for the inventive use, it can be provided that the main frame has an additional cross bar, to which the supports fixed to the backrest in its table position is pivotally mounted, the additional cross bar extending parallel to the seating surface and arranged with spacing to the cross bar holding the backrest.

According to a further exemplary embodiment of the invention, it is provided that the backrest extends beneath the seating surface in its backrest position, which offers the advantage that the extension provided between the pivoted-out seating surface parts of the backrest serving as the table top provide a larger table surface. Also exemplary embodiments of the invention are also included, in which the backrest, when fulfilling its backrest function, only reaches to the seating surface of the seating furniture; in this case, a table top with smaller dimensions is provided when the backrest is pivoted up.

According to an exemplary embodiment of the invention, it is advantageous if the rear support legs form a one-piece component of the main frame holding the backrest pivotably mounted thereto.

According to a further exemplary embodiment of the invention, it is provided that each seating surface part has an inner support leg, which, respectively, is arranged centrally under the separating strips of the seating surface parts that contact one another in the pivoted-in position, and therewith, provides a support of the respective seating surface part on three support legs. This provides the advantage that the initially inner-disposed support leg is positioned into the pivoted-out position of the seating surface parts on the front side of the seating surface parts, so that in this manner, based on the release of the corner region of the seating surface part to the space covered by the table top, an improved access between the seating surface part and table top is provided.

BRIEF DESCRIPTION OF THE DRAWINGS

In the drawings, an exemplary embodiment of the invention is provided, which will be described in detail below. In the drawings.

DETAILED DESCRIPTION OF SPECIFIC EMBODIMENTS

Figure 1:
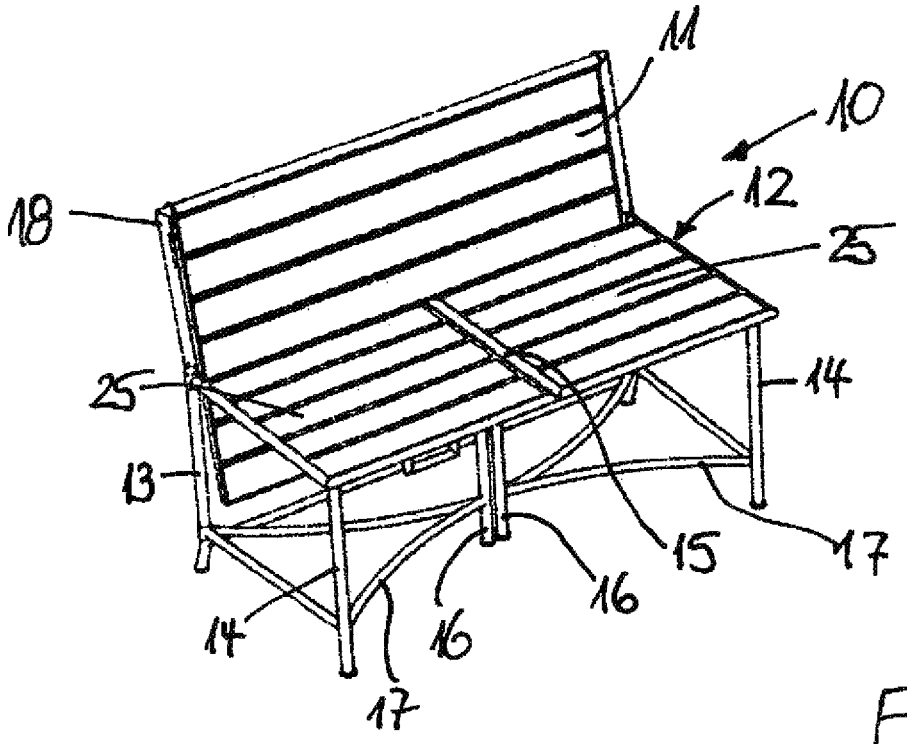
FIG. 1 shows an item of seating furniture formed as a bench in an isometric view.

The bench 10 shown in FIG. 1 has a backrest 11 and a seating surface 12. The bench has two rear support legs 13 and two front support legs 14, respectively, disposed in the corner regions of the seating surface 12. As can be seen in FIG. 1, the seating surface 12 of the bench 10 is separated by two separating strips 15 that contact one another, so that two seating surface parts 25 that are separated from one another are provided. With the exemplary embodiment shown, an inner support leg 16 is arranged approximately centrally beneath each separating strip 15, so that each seating surface part 25 is supported by three support legs, whereby the three support legs 13, 14 and 16 assigned to a respective seating surface part 25 are connected to one another in their ground-level region, respectively, by cross bars 17.

The backrest 11 is surrounded by a rectangular main frame 18 and held thereon, whereby rear support legs 13 of the bench 10 are connected with the shown exemplary embodiment as one piece with the main frame 18. As provided in the further figures, the main frame 18 has at its upper end a cross bar 19 extending parallel to the seating surface 12. The upper edge of the backrest 11 is pivotably mounted to the cross beam 19 by means of a correspondingly formed mechanism. As can be seen further from FIG. 1, the backrest 11 extends in the illustrated backrest position beneath the seating surface 12.

Figure 2:
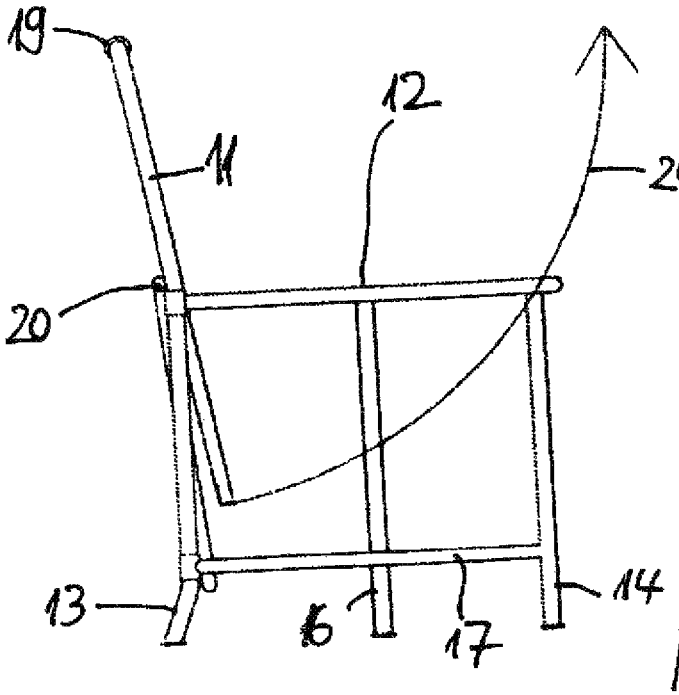
FIG. 2 shows the bench according to FIG. 1 in a side view.
Figure 3:
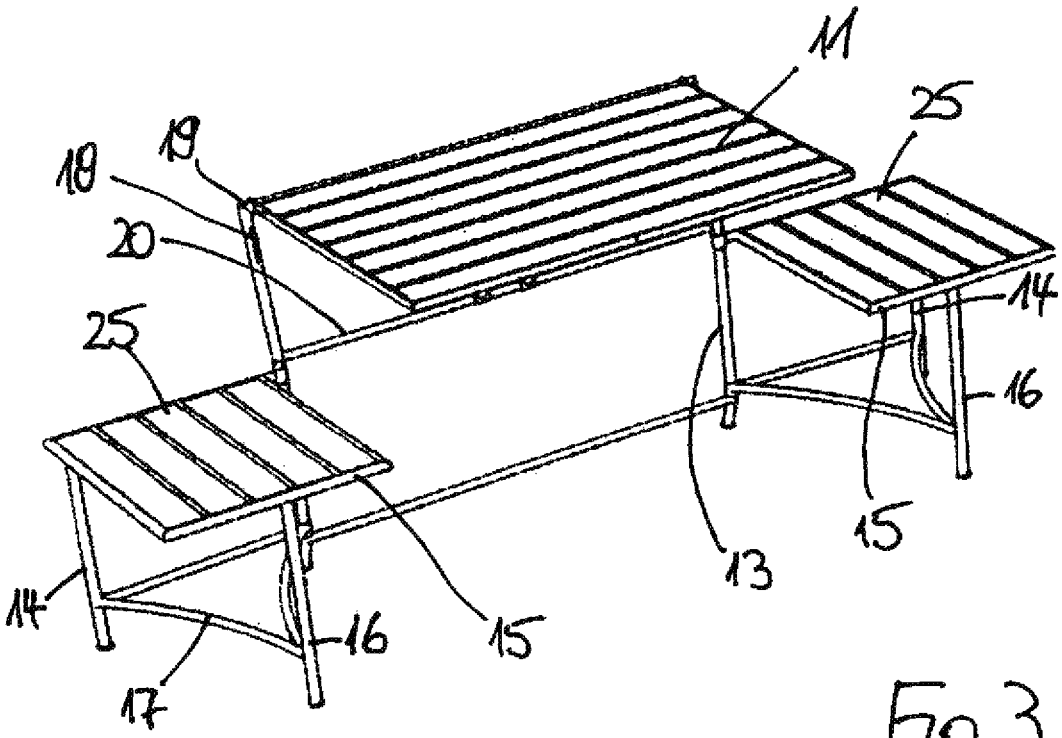
FIG. 3 shows the bench according to FIG. 1 in an isometric view with the backrest brought into the table position.
Figure 4:
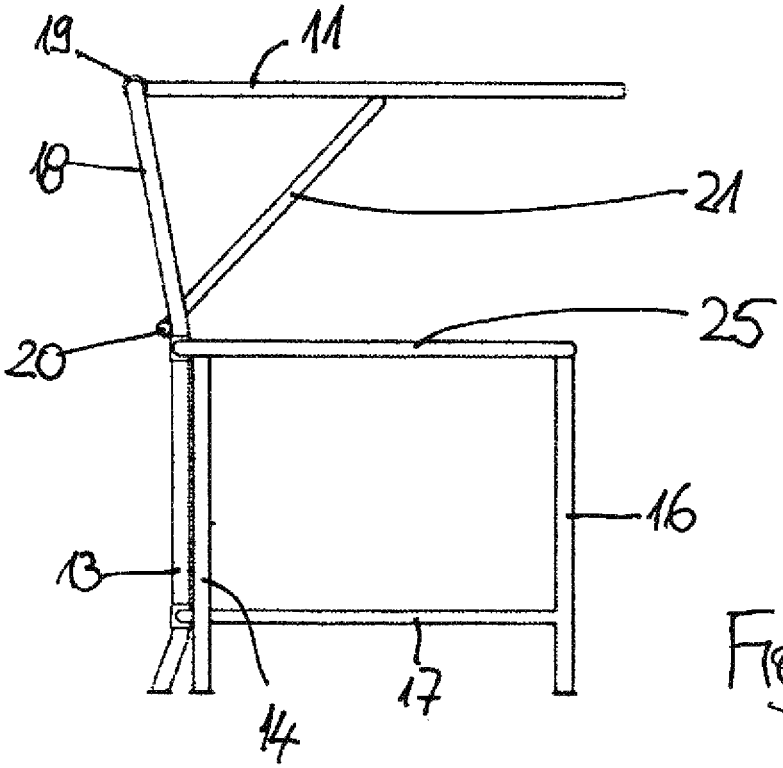
FIG. 4 shows the bench according to FIG. 2 in a side view.
Figure 5:
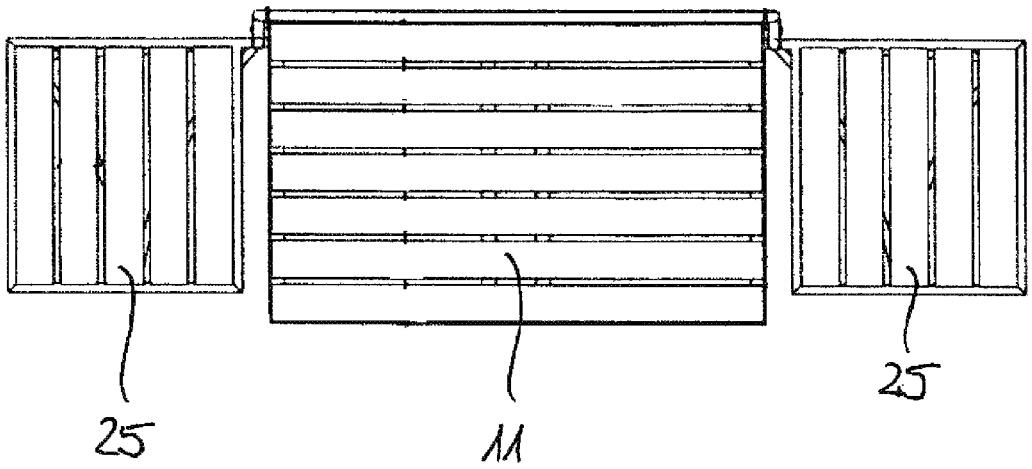
FIG. 5 shows the bench according to FIG. 2 in a plan view.

In order to bring the bench shown in FIG. 1 into the integrated table function, it is necessary to outwardly pivot at 90° the two seating surface parts 25 to be manipulated that are separated based on the arrangement of the separating strips 15 so that an intermediate space exists between the pivoted-out seating surface parts 25, which corresponds at least to the width of the backrest 11. As indicated in FIG. 2 by the arrow 24 and shown in FIG. 3, the backrest 11 is folded up after pivoting out of the seating surface part 25 into the intermediate space formed between the seating surface parts 25 about the upper cross bar 19 of the main frame 18 and is fixed in this folded-up table position by means of a support 21 that is pivotably mounted to the additional, center cross bar 20 of the main frame 11. In the functional position shown in FIGS. 3 through 5, from the bench shown in FIG. 1, now a seating group comprising two oppositely disposed seats in the form of seating surface parts 25 is produced with a table formed by the backrest 11 lying therebetween. Since the initially inner support leg 16 comes into contact on the front side of the thus-formed seating group, based on the outward pivoting of the seating surface part 25 about 90°, the corner region between the respective seating surface part 25 and the space covered by the backrest 11 serving as the table top is held free, so that easy access is provided from the front side for a person who wishes to take the space on the seating surface part 25.

The features of the subject matter of this specification that are disclosed in the foregoing description, the patent claims, the drawings, and the abstract can be important individually as well as in any combination for realization of the invention in its various embodiments.

The specification incorporates by reference the disclosure of German patent application DE 20 2011 051 177.4, filed Sep. 1, 2011 as well as PCT/EP2012/053389, filed Feb. 29, 2012.

The present invention is, of course, in no way restricted to the specific disclosure of the specification and drawings, but also encompasses any modifications within the scope of the appended claims.

The invention claimed is:

1. A bench, comprising:

a backrest portion;

a main frame;

a seating surface with two rear support legs and two front support legs arranged in respective front, outer corner regions of the seating surface, wherein the backrest portion extends between the two rear support legs, wherein the seating surface is divided perpendicularly to the plane of the backrest portion to form two seating surface parts, and wherein each of said seating surface parts further has at least one inner support leg, wherein the two seating surface parts are pivotable about the respective rear support legs into a seating position that is transverse to the backrest portion, wherein and the backrest portion is pivotally mounted on the main frame and is pivotable out of a backrest position between the seating surface parts when in an outwardly pivoted position and into a horizontal table position that is at a vertical distance from the seating surface of the seating surface parts, wherein said backrest portion is securable in said horizontal table position using a support, wherein said support is mounted on the main frame.

2. The furniture item according to claim 1, wherein the backrest portion is pivotable about a cross bar arranged at an upper end of the main frame that extends parallel to the seating surface.

3. The furniture item according to claim 1, wherein the main frame has a further cross bar that extends parallel to the seating surface and is arranged with a spacing to the cross bar holding the backrest portion, and wherein the support that secures the backrest portion in its table position is pivotably mounted to the further cross bar.

4. The furniture item according to claim 1, wherein the backrest portion extends beneath the seating surface in its backrest position.

5. The furniture item according to claim 1, wherein the rear support legs form a one-piece component of the main frame holding the backrest portion that is pivotably mounted to the main frame.

6. The furniture item according to claim 1, wherein the seating surface parts include separating strips, wherein each of said seating surface parts has an inner support leg, which, respectively, is arranged centrally beneath the separating strips of the seating surface parts, said separating strips contacting one another in the pivoted-in position.

* * * * *